United States Patent [19]

Gruber et al.

[11] 4,378,420

[45] Mar. 29, 1983

[54] PROCESS FOR CHARGING TONER COMPOSITIONS

[75] Inventors: Robert J. Gruber, Pittsford; Steven B. Bolte; Richard F. Koehler, Jr., both of Webster; Edward W. Connors, Rochester, all of N.Y.

[73] Assignee: Xerox Corporation, Stamford, Conn.

[21] Appl. No.: 298,983

[22] Filed: Sep. 3, 1981

[51] Int. Cl.[3] ..... G03G 13/08; G03G 9/10; G03G 21/00

[52] U.S. Cl. ..... 430/120; 430/108; 430/110; 430/137

[58] Field of Search ..... 430/108, 110, 120, 137

[56] References Cited

U.S. PATENT DOCUMENTS

| | | | |
|---|---|---|---|
| 3,922,381 | 11/1975 | Datta . | |
| 4,068,017 | 1/1978 | Westdale . | |
| 4,071,655 | 1/1978 | Brana et al. | 430/108 X |
| 4,073,980 | 2/1978 | Westdale et al. | 428/404 |

OTHER PUBLICATIONS

"Toner Concentration Control Apparatus", Res. Discl. 9502, Mar., 1972, pp. 32–35.

*Primary Examiner*—Roland E. Martin, Jr.

*Attorney, Agent, or Firm*—E. O. Palazzo

[57] ABSTRACT

This invention is generally directed to an improved process for rapidly charging uncharged replenishment toner particles to a positive polarity, and the use of such particles for developing images in an electrostatographic imaging system, which process comprises (1) adding uncharged replenishment toner particles to a charged developer composition comprised of carrier particles and toner particles, the carrier particles consisting of a core containing a polymer coating thereon having incorporated therein an additive having a pKa of less than 5, said additive being selected from the group consisting of perfluorooctanoic acid, 2,4-dinitrophenol, 2,4,6-trinitrophenol, and naphthalene sulfonic acids, (2) contacting the charged developing composition containing said carrier particles with the uncharged toner particles, wherein positive charges are transferred to the uncharged toner particles within a mixing period of from about 5 seconds to about 5 minutes, thereby resulting in substantially the same level of positive charge intensity for said uncharged toner particles as the charge intensity of toner particles in the charged developer composition, said charge intensity ranging from about 0.1 femtocoulombs per micron, to about 3 femtocoulombs per micron of toner particles.

5 Claims, 2 Drawing Figures

SLOW ADMIX CHARGING

Figure 1A:
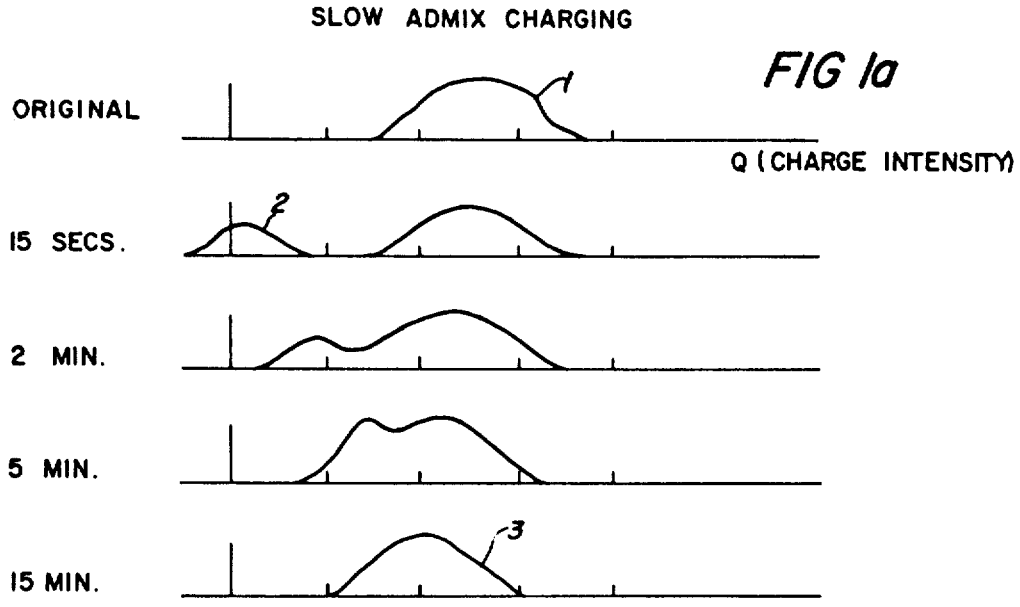

ORIGINAL
1
Q (CHARGE INTENSITY)
15 SECS.
2
2 MIN.
5 MIN.
15 MIN.
3

RAPID ADMIX CHARGING

ORIGINAL
Q (CHARGE INTENSITY)
2
1
15 SECS.
2 MIN.
5 MIN.
15 MIN.

PROCESS FOR CHARGING TONER COMPOSITIONS

BACKGROUND OF THE INVENTION

This invention is generally directed to a process for rapidly charging uncharged toner particles to a positive polarity, and more specifically, to a process for rapidly charging uncharged toner particles added to a charged developing composition by employing in the process polymer coated carrier particles containing thereon or therein certain specific additives for the purpose of increasing the rate at which the uncharged toner particles are charged to a positive polarity.

The formation and development of images on the surface of photoconductive materials by electrostatic means is well known, particularly wherein the latent image is developed by applying toner particles thereto using for example, the cascade development method as described in U.S. Pat. No. 3,618,552, magnetic brush development as disclosed in U.S. Pat. Nos. 2,874,063, and 3,251,706, or touchdown development, reference U.S. Pat. No. 3,166,432. Also known is the production of a reverse copy of an original, thus for example, a negative copy can be produced from a positive original, or positive copy can be obtained from a negative original.

In these processes, especially in cascade development, generally a developer composition comprised of relatively large carrier particles containing finely divided toner particles electrostatically clinging to the surface of the carrier particles is conveyed to and rolled or cascaded across the surface bearing the electrostatic latent image. Negatively charged electrostatic latent images are developed by utilizing a toner and carrier combination wherein the tone is triboelectrically charged positive in relation to the carrier, while positively charged electrostatic images are developed utilizing a toner and carrier combination wherein the toner is triboelectrically charged negative in relation to the carrier material. The triboelectric relationship between the toner and carrier particles is primarily dependent on the relative position of these materials in the triboelectric series, wherein they are arranged in ascending order of their ability to assume a positive charge. Thus for example, each material is positive in this series with respect to any material classified below it, and negative with respect to any material classified above it. As the developer mixture cascades or rolls across the image bearing surface, the charged toner particles are electrostatically attracted to the charged portions of the image bearing member, whereas they are not electrostatically attracted to the uncharged or background portions of the image subsequent to development. Subsequently, the unused toner and carrier particles can be recycled into the developer supply reservoir.

In another form of development known as magnetic brush development, a developer material comprised of toner particles and magnetic carrier particles is transported by a magnet, whereby the magnetic field of the magnet causes alignment of the magnetic carriers, in relation to the electrostatic latent image bearing surface, causing the toner particles to be attracted to the electrostatic image by electrostatic attraction, reference U.S. Pat. No. 2,874,063.

The use of certain charge control agents for the purpose of imparting a positive charge to the toner particles contained in the developer composition is also known. Thus for example, the use of quaternary ammonium salts as charge control agents for electrostatic toner compositions is disclosed in U.S. Pat. No. 3,893,935. In accordance with the disclosure of this patent, certain quaternary ammonium salts when incorporated into toner materials were found to provide a toner composition which exhibited relatively high uniform and stable net toner charge, when mixed with a suitable carrier particle. U.S. Pat. No. 4,079,014 contains a similar teaching with the exception that a different charge control agent is used, namely a diazo type compound.

Carrier materials utilized in the developer mixture, and in the development of electrostatic images are described in many patents including U.S. Pat. No. 3,590,000, the type of material used being dependent for example on a number of factors, such as the type of development process employed, the quality of image development desired, the composition of the imaging member, and the like. In many instances, the carrier materials utilized should have a triboelectric value commensurate with the triboelectric value of the toner particles, in order to enable electrostatic adhesion of the toner particles to the carrier particles. Additionally, carrier particles which have carrier coatings thereon should preferably be comprised of coatings having a certain hardness, primarily for durability purposes, however, the materials should not be of a hardness that will scratch the imaging member surface, upon which the electrostatic image is initially placed. Carrier particles should also be selected that are not brittle so as to cause flaking of their surface, or particle breakup under the forces exerted on the carrier during use, as this will cause undesirable effects since, for example, the flakes produced may be transferred to the imaging surface thereby reducing the quality and readability of the final image.

Recent efforts have been concerned with polymer carrier coatings that can be recycled, and do not cause any harmful undesirable effects to the imaging surface. However, many of the coatings utilized deteriorate rapidly particularly when employed in a continuous process, and in some instances the entire coating separates from the carrier core in the form of chips or flakes, which may be caused by poor adhesion of the coating material that fails upon contact with machine parts, and other carrier particles. Also the triboelectric values of some carrier coatings fluctuate when changes in relative humidity occur, thus such carriers are not desirable for use in electrostatic systems since they adversely affect the quality of the resulting image.

Many of the above described developers, have a tendency to lose their charge over an extended period of time, and in some instances charge control additives employed to reduce this loss are incompatible with the thermoplastic resin, thus making it difficult to uniformly disperse or dissolve such materials in the toner. Additionally, when new uncharged replenishment toner is added to the charged developer composition that is contained in the electrostatographic system, it does not acquire the desired positive charge until a substantial period of mixing has been accomplished. It is important in order to obtain high quality images on a continual basis, as well as for other purposes, that the new replenishment toner being added acquires rapidly the appropriate charge. Also some of the additives, such as the charge control agents of U.S. Pat. No. 3,893,935 are soluble in water, causing them to be leached to the toner surface by moisture, thereby adversely affecting the machine environment and copy quality.

New replenishment toner particles being added to a developer composition contained in a commercial electrophotographic device has essentially a neutral average charge. In order for the toner to properly cause development of an electrostatic latent image, it must be charged to an appropriate level, which generally involves substantial mixing of the replenishment toner particles with the developer composition for a period of time equal to or greater than 15 minutes. Such a time delay is undesirable as the replenishment toner particles can be printed out as background, and the electrical properties of the developer composition are adversely affected, to the extent that images of low quality and low resolution result, and in some instances development does not occur. Also, replenishment toner particles not charged to the appropriate polarity and magnitude can cause contamination as a result of the deposition of such particles on machine parts, thereby eventually, for example, causing the failure of charging corotrons, filters, and the like. Such failures are not only costly, but result in images of low quality, or no images whatsoever.

THE PRIOR ART

Disclosed in U.S. Pat. No. 4,073,980 are treated carrier particles which can be used in developer mixes for the purpose of increasing the useful life of the developer, and also to provide desired triboelectric properties. In accordance with the disclosure of this patent, there is adhered to the surface of a carrier particle a mixture of a perfluorocarboxylic acid, or derivative thereof, and a dry lubricant, such as molybdenum disulfide. Such a coating was found to result in carriers having a longevity and an abrasion resistance which is significantly greater than untreated carrier particles, or carrier particles coated with perfluorocarboxylic acid itself, and further the triboelectric properties of a developer composition containing such carriers was vastly improved over particles coated only with similar molybdenum disulfide materials. Examples of perfluorocarboxylic acids disclosed in this patent include perfluoro octanic acid, reference column 2, beginning at line 40. It is also indicated in column 2 beginning at around line 53 that derivates of perfluorocarboxylic acids such as salts, esters and amides can be employed. This patent, however, does not, for example, diclose the treatment of polymer coated carrier particles with additives for the purpose of rapidly charging uncharged replenishment toner particles being added to a charged developer composition.

In U.S. Pat. No. 3,922,381 there is disclosed carrier particles for use in electrophotographic processes, which carrier particles contain a coating of a perfluorocarboxylic acid, thus resulting in carriers having a longevity which is significantly greater than untreated carrier particles, or carrier particles coated with various other polymers. Examples of acids disclosed include perfluorooctanoic acid, reference column 2, beginning at around line 31. Further, this patent discloses that the resulting carriers are capable of imparting a positive triboelectric charge to electroscopic powders mixed therewith. There is no disclosure in this patent with regard to rapidly charging uncharged replenishment toner particles being added to a developer composition.

U.S. Pat. No. 3,850,676 discloses the use of a developer mixture wherein the carrier particles are coated with a thin layer of a solid polyphenylene oxide resin, or a blend of a polyphenylene oxide resin and a thermoplastic or thermosetting resin. Carrier particles containing such coatings possess high resistance to toner impaction, and coating abrasion resistance, however, the triboelectric properties of these carrier particles are unsuitable for use in developing electrostatic latent images when the imaging member is charged to a negative polarity.

In U.S. Pat. No. 3,778,262 there is disclosed coated carrier particles, wherein the coating is comprised of a mixture of a fluoropolymer and an epoxy material, however, these coatings are usually brittle, and have poor adhesion properties, thus causing them to separate, flake or break away from the carrier cores. Consequently, the triboelectric charging properties of these carrier materials becomes non-uniform, resulting in poor quality development.

Accordingly, there is a need for a process wherein new uncharged replenishment toner particles being added to an already charged developer composition can acquire charge at the appropriate level and magnitude over a short period of mixing time, that is less than 5 minutes, referred to herein as fast or rapid admix charging by utilizing coated carrier materials containing certain additives; while simultaneously providing carrier particles or carrier beads that do not have a tendency to deteriorate, flake or chip during the development process. Additionally, it would be desirable to accomplish such rapid admix charging without introducing chemically active materials, such as complex charge control agents into the developer composition, or into the toner resin.

SUMMARY OF THE INVENTION

It is a feature of this invention to provide a process which overcomes the above-noted disadvantages.

It is a further feature of this invention to provide a process for rapidly charging uncharged replenishment toner particles to a positive polarity.

A further feature of the present invention is the provision of a process for rapidly charging uncharged toner particles wherein there is employed carrier particles containing thereon certain coating additives which function as a charge enhancing media.

Another feature of the present invention is the provision of a process for providing positively charged toners which will develop electrostatic latent images containing negative charges on imaging surfaces, which toner particles will transfer effectively to plain bond paper without causing blurring or adversely affecting the quality of the resulting image.

These and other features of the present invention are accomplished by the provision of an improved process for rapidly charging uncharged replenishment toner particles to a positive polarity which comprises adding uncharged replenishment toner particles to a charged developer composition comprised of carrier particles and toner particles, the carrier particles being comprised of a core containing a polymer coating thereon having incorporated therein an additive material of a pKa of less than 5, said additive being selected from the group consisting of perfluorooctanoic acid, 2,4-dinitrophenol, 2,4,6-trinitrophenol, and naphthalene sulfonic acids, as well as related nonpolymeric materials and polymeric materials, wherein the developer composition containing the coated carrier particles is contacted, for example by mixing with the uncharged toner particles, causing positive charges to be transferred to the uncharged toner particles within a mixing period of from about 5 seconds to about 5 minutes, thereby resulting in substantially the same level of positive charge intensity for said uncharged toner particles and the toner particles initially contained in the charged developer composition, such charge intensity ranging from about 0.1 femtocoulombs per micron (diameter of the toner particle), to about 3 femtocoulombs per micron, (fc/$\mu$) and preferably from about 0.5 fc/$\mu$ to about 1.5 fc/$\mu$. Therefore, in accordance with the improved process of the present invention, new uncharged toner particles being added as replenishment material to a charged developer composition comprised of toner particles and carrier particles are rapidly charged when coated carrier particles contained in such developer composition have incorporated therein the additives of the present invention. This is known as rapid admix charging. By admix charging is meant providing the appropriate charges, for example, positive charges, at a rapid rate to new uncharged toner particles; replenishment toner, being added to toner and carrier particles which contain charges thereon.

As is customary in xerographic imaging systems, new toner must be added to the system as toner is being consumed for the development of images. In substantially most instances in the past, the new uncharged toner particles being added did not achieve the appropriate charge level until a significant period of mixing time had elapsed, for example, after more than 5 minutes, and usually after 10 to 15 minutes. This slow charging adversely affected the use of the developer composition, thus high quality images would not result until the new uncharged toner particles had acquired an electrical charge of the appropriate polarity and the proper magnitude. In some instances, no images whatsoever could be developed until the uncharged toner was mixed for 10 to 15 minutes, with the charged developer composition contained in the in the machine system being used. Although there is disclosed in copending applications that the admixing time can be decreased by adding various materials to the toner resin, such copending applications do not teach the addition of additives to the carrier coating for accomplishing such rapid admix charging.

Additives that may be included in the carrier coating to enhance the admix rate in accordance with the process of the present invention, which additives are present in amounts of from about 0.1 percent to about 10 percent, and preferably from about 1 percent to about 5 percent, include those additives having a pka of less than 5, such as perfluorooctanoic acids, nitrophenols, such as dinitrophenols, trinitrophenols and the like, the preferred nitrophenols being 2,4,6-trinitrophenol and 2,4-dinitrophenol, naphthalene sulfonic acids, as well as related nonpolymeric materials; and polymers and the like. The preferred additives to be utilized in the process of the present invention are perfluorooctanoic acid, and 2,4,6-trinitrophenol primarily since they are available commercially, and provide rapid admix charging within a period of substantially less than 5 minutes. These additives which are preferably present in an amount of from about 1 percent to 5 percent can be incorporated into the carrier coating by a number of known methods including mixing with the coated carrier particles during fabrication of the developing composition by using, for example, known fluid bed coaters.

Typical carrier core materials that may be coated include glass, silicon dioxide, methylmethacrylate, flint shot, magnetic materials, such as iron, steel, ferrite, nickel, and mixtures thereof. Generally, these carrier materials contain known polymer coatings thereon including fluorocarbon polymers such as polyvinylidene fluoride, or polymers and copolymers coatings of polyvinyl chloride, vinyl acetates, polystyrenes, polycarbonates, polyesters, styrene butylmethacrylate copolymers, styrene butylmethacrylate siloxy terpolymers and the like. The carrier particles used generally have an average diameter of from about 30 microns to about 500 microns, since such a carrier possesses sufficient density and inertia to avoid adherence to the electrostatic image during the development process. Adherence of carrier particles to the electrostatographic photoreceptor imaging surface is undesirable, as deep scratches are usually formed when the imaging surface containing the adhered carrier particles is cleaned by known web cleaning devices.

Illustrative examples of finely divided toner resin particles that may be employed with the coated carriers of the present invention include various polymeric materials, such as natural and synthetic resins like gum copal, gum sandarac, rosin cumarone-indene resin, asphaltum, gilsonite, phenolformaldehyde resins, rosin modified phenolformaldehyde resins, methacrylate resins, polystyrene resins, epoxy resins, polyester resins, polyethylene resins, polybutadiene resins, styrene butadiene resins, vinyl chloride resins, and copolymers or mixtures thereof. A preferred toner resin is comprised of a copolymer of styrene and n-butylmethacrylate. Among patents describing electrostatic toner compositions that would be useful in the present invention, reference is made to U.S. Pat. Nos. 2,569,670, 2,753,308, 3,070,342, Reissue 25,136, and 2,788,288. Such toner particles generally have an average particle diameter of between about 5 microns, and about 30 microns.

In order to be useful as a toner, the above-identified resins have added thereto a suitable pigment or dye, such as for example carbon black, nigrosine dye, aniline blue, calco oil blue, chrome yellow, ultramarine blue, malachite green oxalate, lamp black, Rose Bengal, Monastral Red, Sudan Black BN, and mixtures thereof. The pigment or dye should be present in the toner in a sufficient quantity to render it highly colored in order that it will form a uniformly visible image on the recording member, the colorant being present in amount of from about 5 percent by weight to about 30 percent by weight, and preferably from about 5 percent by weight to about 10 percent by weight.

Generally the developer mixture contains toner particles in concentrations of about 1 part toner to about 10 to 200 parts by weight of carrier material.

The developing compositions of the present invention may be used to develop electrostatic latent images on various suitable imaging surfaces capable of retaining charge, including conventional photoreceptors, however, the developers of the present invention are best utilized in systems wherein negative charges reside on the photoreceptor, and this usually occurs with organic photoreceptors, illustrative examples of which are polyvinylcarbazole, 4-dimethylaminobenzylidene, 2-benzyldene-aminocarbazole, 4-dimethylaminobenzyldene, benzhydrazide, 2-benzyldene-aminocarbazole, 2,4-diphenyl-quinazoline, 1,2,4-triazine, 1,5-diphenyl-3-methylpyrazoline, polyvinylcarbazole-trinitrofluorenone charge transfer complexes, phthalocyanines, various layered photoreeptor devices such as those containing a substrate overcoated with a charge generator layer, such as vanadyl phthalocyanine, which in turn is overcoated with known transport layers, and the like.

Accordingly, the present invention also envisions the development of electrostatic latent images which comprises causing the formation of an electrostatic latent image on an image bearing member, developing the image with a positively charged developer composition comprised of carrier particles and toner particles, which composition has added thereto uncharged replenishment toner particles, the carrier particles being comprised of a core containing a polymer coating thereon having incorporated therein an additive material of a pka of less than five, said additive being selected from the group consisting of perfluorooctanic acid, 2,4-dinitrophenol, 2,4,6-trinitrophenol and naphthalene sulfonic acid, wherein the uncharged replenishment toner particles are charged to a positive polarity by contacting the carrier particles with the uncharged toner particles causing positive charges to be transferred from the carrier particles to the uncharged toner particles within a mixing period of from about 5 seconds to about 5 minutes, thereby resulting in the same level of positive charge intensity for the toner particles initially contained in the charged developer composition and the uncharged replenishment toner particles, such charge intensity ranging from about 0.1 femtocoulombs per micron to about 3 femtocoulombs per micron, and preferably from about 0.5 femtocoulombs per micron to about 1.5 femtocoulombs per micron, followed by transferring the image to a suitable substrate, and permanently affixing the image thereto.

The following examples are being supplied to further illustrate various embodiments of the present invention, it being noted that these examples are intended to illustrate and not limit the scope of the present invention. Parts and percentages are by weight unless otherwise indicated.

EXAMPLE I

There was prepared by melt blending a toner composition comprised of 90 parts by weight of a styrene/n-butylmethacrylate copolymer resin, 58 percent by weight of sytrene, 42 percent by weight n-butylmethacrylate, and 10 parts by weight of Raven 5750 carbon black commercially available from Cabot Corporation, which toner was micronized to 12 microns volume average diameter.

A developer mixture was prepared by mixing for about 25 minutes two parts by weight of the above toner composition with 100 parts by weight of a carrier consisting of a ferrite core, 100 microns in diameter, coated with 1.2 percent by weight of a flourinated copolymer of trifluorochloroethyene, and vinyl chloride, commercially available from Firestone Company (FPC-461).

When uncharged toner particles comprised of 90 parts by weight of a styrene/n-butylmethacrylate copolymer resin (58/42) and 10 parts by weight of carbon black are added to the above prepared developer mixture, the admix charging rate was about 15 minutes, that is, the new uncharged toner particles acquired a charge of 0.1 femtocoulombs per micron (fc/$\mu$) in 15 minutes. The amount of charge acquired and the time within which it was acquired was measured on a toner charge spectrograph. This instrument disperses toner particles in proportion to their charge/diameter and with the aid of automated microscopy can generate charge distribution histogram or curves for selected toner size classes. Use of the spectrograph allows the monitoring of the admixed toner charging rate as illustrated hereinafter. Should the admix rate be slow the uncharged toner will form a second peak in the distribution curves discussed hereinafter. Charge distribution time sequences can thus be used to distinguish between slow and rapid admix charging rates.

When the above developer mixture containing recently added uncharged toner particles comprised of 90 percent by weight of a styrene n-butylmethacrylate copolymer resin (58/42), 10 percent by weight of carbon black is employed in a xerographic imaging system images of low quality and poor resolution are produced for about 15 minutes, which copy quality begins to improve after 15 minutes, indicating that the uncharged toner particles have not acquired the appropriate level of charge until after 15 minutes.

Similar imaging results were obtained when 5 percent by weight of monomeric acid, and 5 percent by weight of methyl perfluorooctanate were added to the carrier coating of the developer mixture, that is, the uncharged toner particles did not acquire an appropriate charge until at least 15 minutes mixing time. Images of low quality were obtained for 15 minutes when utilizing developer compositions containing carrier coatings with these additives, in a xerographic imaging system.

EXAMPLE II

The procedure of Example I was repeated with the exception that there was added to the carrier coating five percent by weight of the additive perfluorooctanoic acid, pKa of 0.2 with the result that when uncharged toner particles containing 90 parts by weight of a styrene n-butylmethacrylate copolymer resin (58/42), and 10 parts by weight carbon black were added to the developer mixture of Example I with the addition of the above additive to the carrier particles the uncharged toner particles were rapidly charged to a positively polarity of 0.5 fc/$\mu$ in 15 seconds.

When the above developer mixture containing uncharged toner particles is utilized in a xerographic imaging system, wherein the photoreceptor polyvinylcarbazole is charged negatively, there was immediately obtained after one imaging cycle images of high quality and excellent resolution indicating that the new uncharged toner particles had rapidly acquired the appropriate level of charge in 15 seconds.

EXAMPLE III

The procedure of Example II was repeated with the exception that there was employed as the additive 2,4-dinitrophenol pKa, 4 in an amount of 5 percent by weight, resulting in the positive charging of new uncharged toner particles to 0.9 fc/$\mu$ in a period of 2 minutes. Substantially similar imaging results were obtained when the developer mixture of this Example was utilized to develop xerographic images, thus there was immediately obtained after one imaging cycle, images of high quality and excellent resolution, indicating that the new uncharged toner particles had rapidly acquired the appropriate charge polarity and the proper charge magnitude in 2 minutes.

EXAMPLE IV

The procedure of Example II was repeated with the exception that there was used as the additive five percent by weight of 2,4,6-trinitrophenol pKa of 0.4 and the uncharged toner particles were positively charged to 0.8 fc/$\mu$ in 15 seconds.

When the above developer mixture containing uncharged toner particles is utilized in the xerographic imaging system of Example II, there was immediately obtained after one imaging cycle, images of high quality and excellent resolution indicating that the new uncharged toner particles had reapidly acquired the appropriate charge polarity and the proper charge magnitude in 15 seconds.

EXAMPLE V

The procedure of Example II was repeated with the exception that there was used as the additive naphthalene sulfonic acid, 5 percent by weight, pKa of $-7$. The uncharged toner particles were positively charged to 1.1 fc/$\mu$ in 15 seconds.

When the above developer mixture containing uncharged toner particles is utilized in the xerographic imaging system of Example II, there was immediately obtained after one imaging cycle, images of high quality and excellent resolution, indicating that the new uncharged toner particles had rapidly acquired the appropriate charge polarity, and the proper charge magnitude in 15 seconds.

A comparison between the charge distribution curves of a developer mixture containing the toner compositions of Example I and Example II is illustrated in FIG. 1, histograms 1*a* and 1*b*. More specifically, shown in FIG. 1 are plots representing the number of toner particles at a given charge intensity for a uniform particle size. A typical distribution for the developer composition of Example I that has been roll milled for about an hour is shown in FIG. 1*a* by the line curve 1, identified as "original". The particles contained in such a developer composition have a distribution about some average charge, but no particles have a charge near zero as is evident from the distribution curve. The uncharged toner particles of Example I represented by line curve 2, initially have a charge of near zero, and subsequently such toner particles as a result of their mixing with the charged toner particles acquire a charge as shown; until they reach the desired charge level after 15 minutes as illustrated. Thus, after 15 seconds of mixing, the uncharged toner particles have a charge near zero, reference the "peak" of line curve 2, and after two minutes of mixing, such a peak has moved slightly indicating an increase in charge intensity on the uncharged toner particles. However, two peaks remain and a considerable number of toner particles contain little or no charge, rendering them substantially useless for development in a xerographic imaging system.

After 15 minutes of continued admixing, line curve 3 there results a single peak, accordingly, there is one charge distribution representative of all the toner particles contained in the developer composition, that is, all the toner particles possess a similar charge intensity to enable their use in a xerographic imaging system. The time required for the original toner and the added uncharged toner particles to form such a single peak or distribution curve, FIG. 1*a* line 3, is 15 minutes, and this is referred to as the admix time of the toner. It is of course, to be appreciated that in this illustration 15 minutes is required in order to obtain proper admix, however, such time can vary considerably ranging from perhaps of 10 minutes up to an hour, and this is undesirable as explained hereinbefore.

Figure 1B:
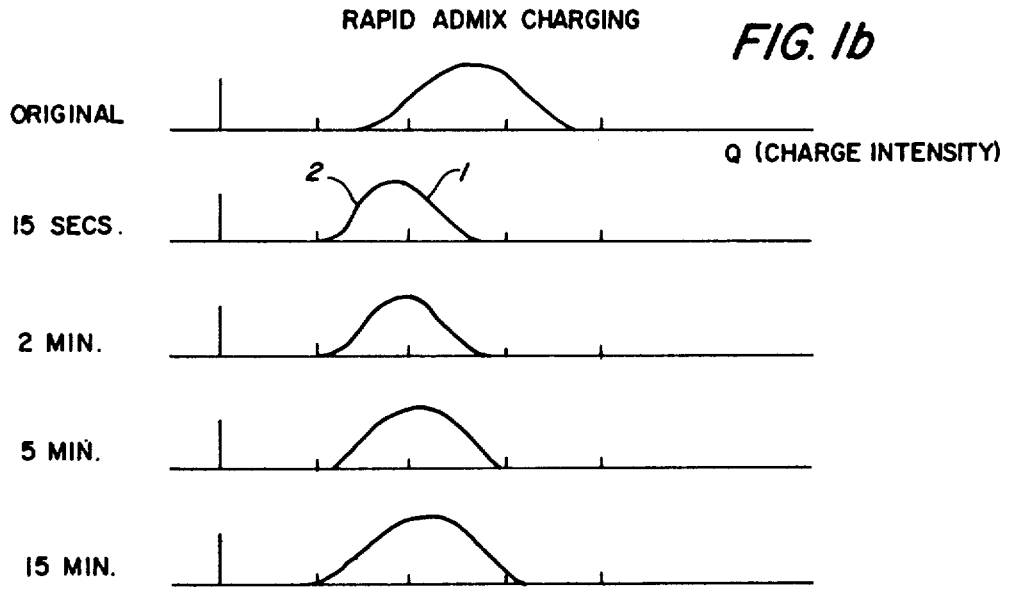

In accordance with the process of the present invention, such admix occurs within 15 seconds utilizing the carrier composition of Example II, reference FIG. 1*b*. As illustrated in FIG. 1*b*, there results after 15 secnds of mixing time, a single peak indicating rapid transfer of charges to the uncharged toner particles, thus the uncharged toner particles are of the same charge intensity as the charged toner particles, complete admix occurring in about 2 minutes. Accordingly, the uncharged toner particles are immediately available for the development of electrostatic latent images. Also as shownn, the toner particles subsequently merge into a single peak after 2 minutes, and five minutes of mixing, however, it is important to note that even after 15 seconds there are no low charge or zero charged toner particles.

Other modifications of the present invention may occur to those skilled in the art upon a reading of the present disclosure and these are intended to be included within the scope of the present invention.

We claim:

1. A method for developing electrostatic latent images contained on an imaging member, which comprises forming an electrostatic latent image on an insulating photoconductive material, contacting the image with a positively charged developer composition, comprised of carrier particles and toner particles, having added thereto uncharged replenishment toner particles, the carrier particles consisting of a core containing a polymer coating thereon, having incorporated therein the additive 2,4-dinitrophenol, or a naphthalene sulfonic acid, wherein positive charges are transferred to the uncharged toner particles within a mixing time of from about 5 seconds to about 5 minutes, said charge ranging from about 0.1 femtocoulombs per micron to about 3 femtocoulombs per micron of said toner particles, transferring the developed image to a permanent substrate, and subsequently permanently fusing thereon.

2. A method for developing electrostatic latent images contained on an imaging member, which comprises forming an electrostatic latent image on an insulating photoconductive material, contacting the image with a positively charged developer composition, comprised of carrier particles and toner particles, having added thereto uncharged replenishment toner particles, the carrier particles consisting of a core containing a polymer coating thereon, having incorporated therein the additive 2,4,6-trinitrophenol, wherein positive charges are transferred to the uncharged toner particles within a mixing time of from about 5 seconds to about 5 minutes, said charge ranging from about 0.1 femtocoulombs per micron to about 3 femtocoulombs per micron of said toner particles, transferring the developed image to a permanent substrate, and subsequently permanently fusing thereon.

3. An improved process for rapidly charging uncharged replenishment toner particles to a positive polarity which comprises: (1) adding uncharged replenishment toner particles to a charged developer composition comprised of carrier particles and toner particles, the carrier particles consisting of a core containing a polymer coating thereon having incorporated therein as an additive 2,4-dinitrophenol, (2) contacting the charged developer composition containing the carrier particles with the uncharged toner particles, wherein positive charges are transferred to the uncharged toner particles within a mixing period of from about 5 seconds to about 5 minutes, thereby resulting in substantially the same level of positive charge intensity for said uncharged toner particles as the charge intensity of toner particles in the charged developer composition, said charge intensity ranging from about 0.1 femtocoulombs per micron, to about 3 femtocoulombs per micron of toner particles.

4. An improved process for rapidly charging uncharged replenishment toner particles to a positive polarity which comprises: (1) adding uncharged replenishment toner particles to a charged developer composition comprised of carrier particles and toner particles, the carrier particles consisting of a core containing a polymer coating thereon having incorporated therein as an additive 2,4,6-trinitrophenol, (2) contacting the charged developer composition containing the carrier particles with the uncharged toner particles, wherein positive charges are transferred to the uncharged toner particles within a mixing period of from about 5 seconds to about 5 minutes, thereby resulting in substantially the same level of positive charge intensity for said uncharged toner particles as the charge intensity of toner particles in the charged developer composition, said charge intensity ranging from about 0.1 femtocoulombs per micron, to about 3 femtocoulombs per micron of toner particles.

5. An improved process for rapidly charging uncharged replenishment toner particles to a positive polarity which comprises: (1) adding uncharged replenishment toner particles to a charged developer composition comprised of carrier particles and toner particles, the carrier particles consisting of a core containing a polymer coating thereon having incorporated therein as an additive naphthalene sulfonic acid, (2) contacting the charged developer composition containing the carrier particles with the uncharged toner particles, wherein positive charges are transferred to the uncharged toner particles within a mixing period of from about 5 seconds to about 5 minutes, thereby resulting in substantially the same level of positive charge intensity for said uncharged toner particles as the charge intensity of toner particles in the charged developer composition, said charge intensity ranging from about 0.1 femtocoulombs per micron, to about 3 femtocoulombs per micron of toner particles.

* * * * *